US005239350A

United States Patent [19]

Godlove

[11] Patent Number: 5,239,350

[45] Date of Patent: Aug. 24, 1993

[54] CLEANING SYSTEM FAILURE DETECTOR

[75] Inventor: Ronald E. Godlove, Bergen, N.Y.

[73] Assignee: Xerox Corporation, Stamford, Conn.

[21] Appl. No.: 967,476

[22] Filed: Oct. 28, 1992

[51] Int. Cl.[5] ..... G03G 21/00

[52] U.S. Cl. ..... 355/299; 15/256.5; 355/203; 355/296

[58] Field of Search ..... 355/203, 205, 206, 296, 355/297, 298, 299, 301; 15/256.5, 256.51

[56] References Cited

U.S. PATENT DOCUMENTS

| | | | |
|---|---|---|---|
| 3,843,407 | 10/1974 | Thorp | 355/299 |
| 3,918,809 | 11/1975 | Hwa | 355/299 X |
| 4,470,689 | 9/1984 | Nomura et al. . | |
| 4,588,280 | 5/1986 | Ogawa et al. . | |
| 4,609,276 | 9/1986 | Mitzutani . | |
| 4,681,426 | 7/1987 | Bean et al. | 355/298 |
| 4,690,544 | 9/1987 | Forbes, II et al. | 355/299 |
| 4,875,077 | 10/1989 | Takamatsu et al. | 355/212 |
| 4,922,305 | 5/1990 | Agarwal | 355/299 |
| 4,937,633 | 6/1990 | Ewing | 355/299 |
| 5,034,774 | 7/1991 | Higginson et al. | 355/256 |

FOREIGN PATENT DOCUMENTS

| | | | |
|---|---|---|---|
| 59-165072 | 9/1984 | Japan | 355/211 |
| 60-131557 | 7/1985 | Japan | 355/211 |
| 63-15267 | 1/1988 | Japan | 355/211 |
| 63-118759 | 5/1988 | Japan | 355/211 |
| 63-193172 | 8/1988 | Japan | 355/211 |
| 1-74578 | 3/1989 | Japan | 355/211 |
| 2-272464 | 11/1990 | Japan | 355/211 |
| 3-80285 | 4/1991 | Japan | 355/211 |
| 3-202859 | 9/1991 | Japan | 355/211 |

*Primary Examiner*—A. T. Grimley
*Assistant Examiner*—William J. Royer
*Attorney, Agent, or Firm*—T. Fair

[57] ABSTRACT

An apparatus for detecting cleaning system failure having a trapping enclosure for particles cleaned from the imaging surface. The failure detector signals a failure in the cleaning apparatus when the level of trapped particles exceeds a preselected quantity.

12 Claims, 3 Drawing Sheets

CLEANING SYSTEM FAILURE DETECTOR

BACKGROUND OF THE INVENTION

This invention relates generally to an electrophotographic printing device, and more particularly a way of detecting the failure of a cleaning system used therein to remove particles adhering to the photoconductive member.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

In a reproduction process of the type as described above, it is inevitable that some residual toner will remain on the photoconductive surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual debris remaining after image transfer.) The residual particles adhere firmly to the surface and must be removed prior to the next printing cycle to avoid its interfering with recording a new latent image thereon.

Various methods and apparatus may be used for removing residual particles from the photoconductive imaging surface. Hereinbefore, a cleaning brush, a cleaning web, and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive. Blade cleaning involves a blade, normally made of a rubber-like material (e.g. polyurethane) which is scraped or wiped across the surface to remove the residual particles from the surface. Blade cleaning is a highly desirable method, compared to other methods, for removing residual particles due to its simple, inexpensive structure. However, there are certain deficiencies in blade cleaning, which are primarily a result of the frictional sealing contact that must occur between the blade and the surface. This frictional contact can cause blade failures such as creating a tear in the blade allowing toner to leak through the blade cleaner. This type of blade failure eventually causes copy quality defects that are large enough to detect on the copy.

The following disclosures may be relevant to various aspects of the present invention and may be briefly summarized as follows:

U.S. Pat. No. 3,918,809 to Hwa discloses an apparatus for cleaning liquid developer from upwardly moving support surface, such as reusable surfaces used for carrying latent electrostatic images. Cleaning blades are used to clean this surface. Separate support members hold the cleaning blades in contact with the surface being cleaned.

U.S. Pat. No. 5,034,774 to Higginson et al. discloses an apparatus for applying toner for developing an electrostatographic latent image formed on the charge retaining surface of a moving recording medium. The apparatus includes compliant cleaning blades disposed for contacting a drying roller to prevent agglomeration of paper fibers and toner particles on the interface between the roller and the scraper blade.

SUMMARY OF INVENTION

Briefly, stated, and in accordance with one aspect of the present invention, there is provided an apparatus for removing residual particles from a surface. The apparatus includes means for cleaning residual particles from the surface. Means for trapping residual particles escaping from the cleaning means. Means, responsive to the residual particles trapped by the trapping means exceeding a preselected quantity, for indicating failure of the cleaning means.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
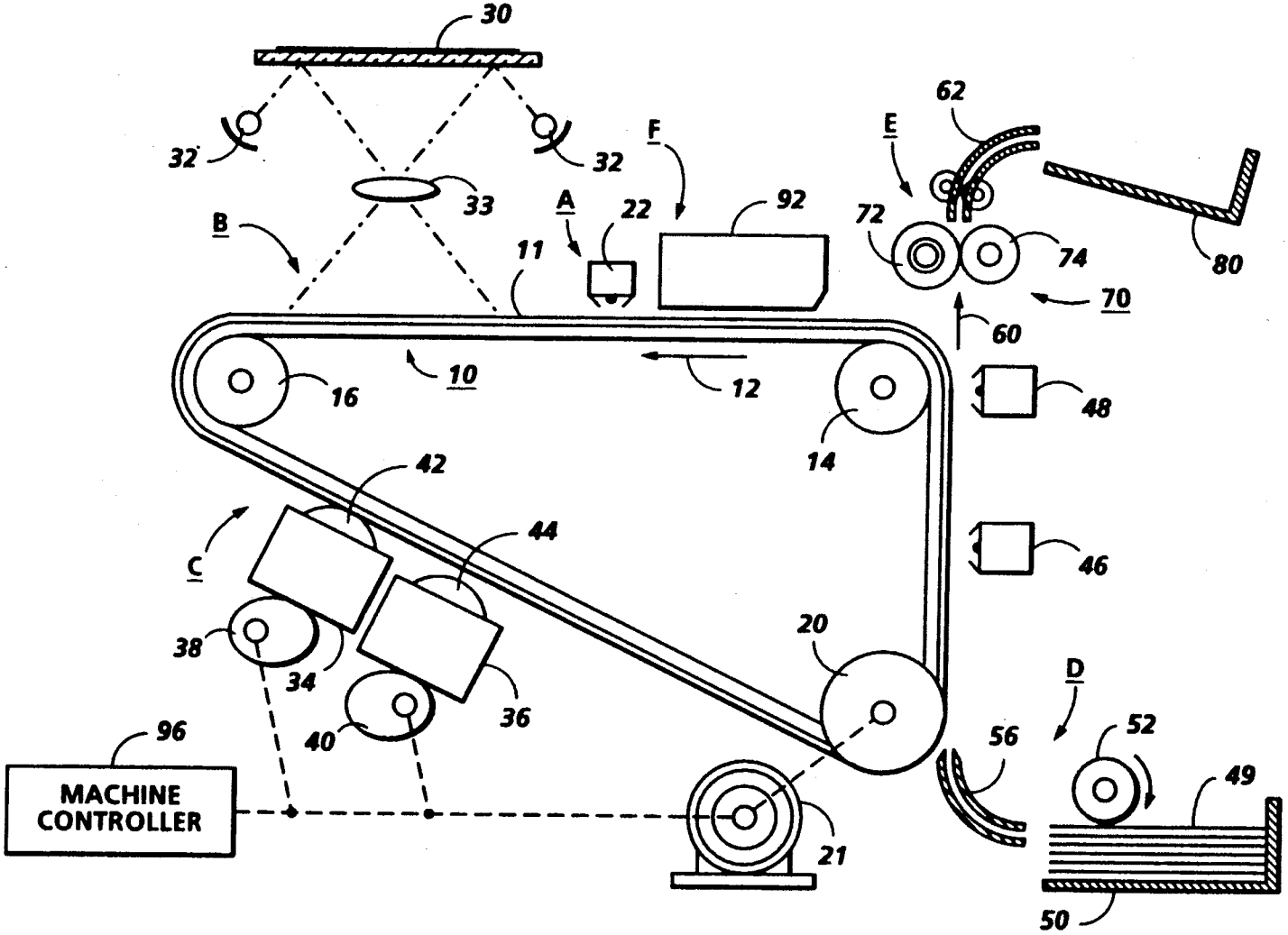
FIG. 4 is a schematic elevational view depicting an electrophotographic printing machine incorporating the features of the present invention therein.

For a general understanding of an electrophotographic printing machine in which the present invention may be incorporated, reference is made to FIG. 4 which depicts schematically the various components thereof. Hereinafter, like reference numerals will be employed throughout to designate identical elements. Although the cleaning system failure detector apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 4 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 4, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a shoot 62 to an output 80 or finisher.

Residual particles, remaining on the photoreceptor belt 10 after each copy is made, may be removed at cleaning station F. The hybrid cleaner of the present invention is represented by the reference numeral 92. (See FIG. 1 for a detailed view of the cleaning blade failure detector apparatus.) Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

Figure 1:
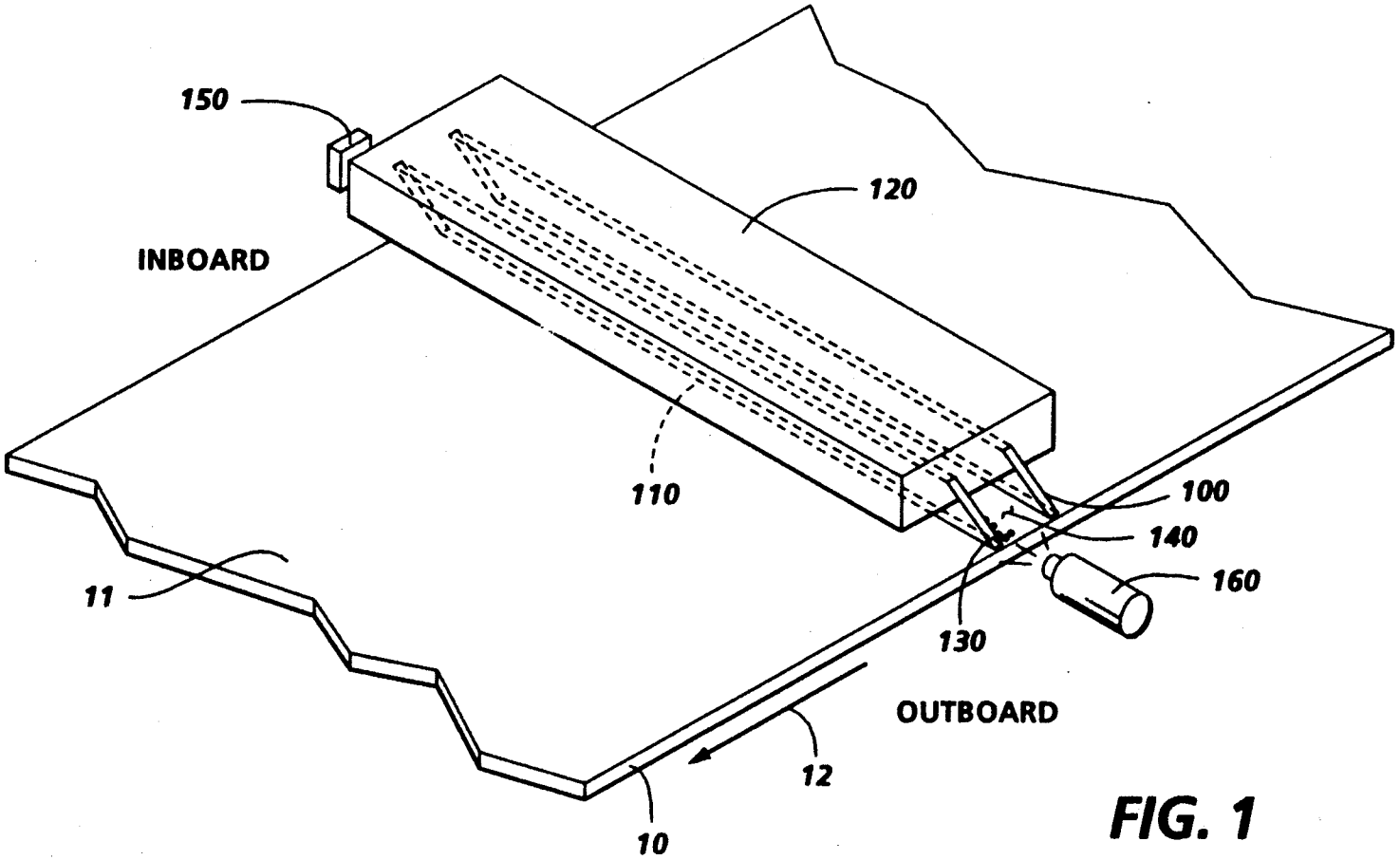
FIG. 1 is a side view depicting two exemplary cleaning blades in the doctoring mode, incorporating the features of the present invention therein.
Figure 2:
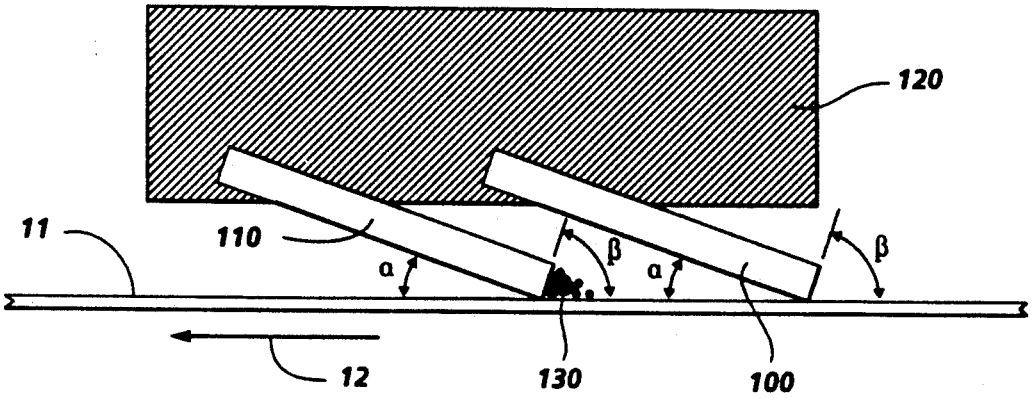
FIG. 2 is a frontal schematic elevational view of the toner build up with cleaning blades in the doctoring mode.
Figure 3:
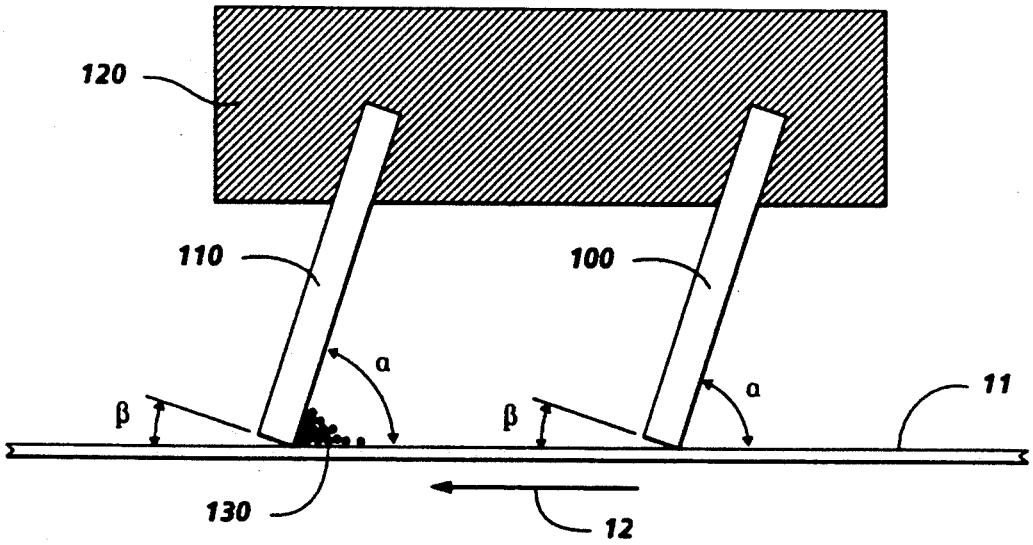
FIG. 3 is a frontal schematic elevational view of the toner build up with cleaning blades in the wiping mode.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 to 3 where the showings are for the purpose of illustrating a preferred embodiment of the invention and not for limiting the same. (i.e., Although the FIGS. 1–3 depict a cleaning blade apparatus, the present invention is also applicable to a brush cleaning or brush/blade cleaning apparatus).

Referring now to FIG. 1, which shows a photoreceptor belt 10 rotating in a clockwise direction, indicated by arrow 12, and two cleaning blades 100, 110. The primary cleaning blade 100 is located ahead of (i.e. upstream from) the secondary cleaning blade in the direction of movement 12 of the photoreceptor 10. The primary cleaning blade 100 removes the majority of the residual particles from the photoreceptor surface. The secondary blade 110 acts as a backup blade, and also as a blade which scrapes off toner streaks in the event of a failure of the primary blade 100. [Although a photoreceptor belt is shown, the proposed invention is applicable to drum type photoreceptors as well. The cleaning blades here are shown in the doctoring or scraping mode but the cleaning blades can also be in the wiping mode (see FIG. 3) or the primary blade in the wiping mode followed by doctoring mode blade or vice versa.] The cleaning blades 100, 110 are supported on the non-cleaning ends by a blade holder 120 common to both blades 100, 110. A tunnel 140 configuration is formed, enclosed on four sides by the two cleaning blades 100, 110; the surface 11 of the photoreceptor 10 between the cleaning blades 100, 110; and the blade holder 120 common to both blades. This tunnel exists along the width of the photoreceptor, terminated by the inboard and outboard ends of the process. Under ordinary circumstances, when the primary cleaning blade 100 has not failed, and there are no toner streaks escaping downstream of the primary cleaning blade 110, the cleaning edge of the secondary blade 110 will be relatively free of the accumulation of toner. Toner 130 will accumulate there over the passage of process running time, but that can be dealt with by the blowing of compressed air through the tunnel 140 every so many copies, or could even be "mopped up" with an appropriately shaped and sized piece of plastic foam or other material that every so many copies would be mechanically moved across the cleaning edge of the secondary blade 110.

With continued reference to FIG. 1, in the event of a failure to the primary cleaning blade 100, the resulting toner streak would be intercepted by the secondary blade 110. This will cause toner to build up much more rapidly on the cleaning edge of the secondary blade 110. [It should be noted that the build up of toner accumulates at different points in the tunnel depending upon the positioning of the blades (e.g. 12, 3, 6, or 9 o'clock) on the photoreceptor and the type of cleaning mode (wiping or doctoring) the blades are in. The photodetector and light source are positioned on either side of the tunnel according to where the toner build up will occur when blade failure occurs which can be other than along the cleaning edge of the secondary blade.] A photodetector 150 and light source 160 are properly arrayed on the inboard and outboard ends of the cleaning edge of the secondary cleaning blade 110. The accumulation of toner 130 piling up there will block the passage of light between the light source 160 (e.g. photoemitter) and photodetector 150, and the output of the detector is used to indicate the failure of the primary cleaning blade 100. However, the secondary blade 110 continues cleaning up the toner streak missed by the failed primary blade 100, and the copying process continues without copy quality defects until the operator is notified of an imminent cleaning blade subsystem failure that results in periodic or unscheduled maintenance. The important distinction is that the operation of the machine is not disturbed, even though a cleaning blade failure has happened. (The secondary cleaning blade 110 and other areas where toner build up and residual particles may occur are periodically cleaned with a blast of air or swab, or by momentarily camming out the blade.) Also, the casual build-up of toner here could be dealt with when the process is not generating copy output by momentarily camming blade 130 away from the moving photoreceptor, allowing the casual build-up of toner to be carried by the belt to the upstream blade 100.

Referring now to FIG. 2, which shows a frontal view of the present invention with the cleaning blades shown in the doctoring mode. The first blade 100 has failed and an accumulation of toner 130 has accumulated on the second blade 110 blocking the light source 160 (see FIG. 1) light from the photodetector 150 (see FIG. 1) signaling that a failure has occurred.

With continued reference to FIG. 2, the blades each have a cleaning edge in frictional contact with the photoreceptor surface 11 opposite the blade ends held by the blade holder 120. The blades contact the surface at a working angle, $\alpha$ (where $\alpha=180°-(\beta+90°)$). In the doctoring mode as shown in FIG. 2, the cleaning blade working angle $\alpha$ ranges from about 10° to 25°, with a preferred angle $\alpha$ of about 15° when the load on the blade is about 35 grams/cm. (It is noted that the backup blade 110 can have a lighter load then that of the primary blade 100 which can affect the angle of the $\alpha$. The lighter load on the second blade decreases the likelihood of blade failure or damage to the photoreceptor surface.)

Referring to FIG. 3, which shows an alternative frontal view of the present invention with the cleaning blades in the wiping mode. The first blade 100 has failed and an accumulation of toner 130 has accumulated on the second blade 110 blocking the light source 160 (see FIG. 1) light from the photodetector 150 (see FIG. 1) signaling a failure. Similar to FIG. 2, the blades each have a cleaning edge in frictional contact with the photoreceptor surface 11. The blades contact the surface at a working angle, $\alpha$ (where $\alpha=180°-(\beta+90°)$). In the wiping mode shown, the cleaning blades working angle $\alpha$ ranges from about 65° to 80°, with a preferred angle $\alpha$ of about 75° when the load on the blade is about 35 grams/cm. It is noted that the backup blade 110 can have a lighter load then that of the primary blade 100 which can affect the angle of the $\alpha$. The lighter load on the second blade decreases the likelihood of blade failure or damage to the photoreceptor surface.)

In recapitulation, it is evident that the cleaning system failure detector of the present invention is an apparatus that traps particles escaping from the cleaning means. A failure detector is positioned such that when the level of particles trapped reaches a predetermined quantity, a cleaning failure is signaled. However, a secondary cleaning means continues cleaning the imaging surface until the failed cleaning means is replaced.

It is, therefore, apparent that there has been provided in accordance with the present invention, a cleaning system failure detector apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing residual particles from a surface, comprising:

means for cleaning residual particles from the surface;

means for trapping residual particles escaping from said cleaning means; and means, responsive to the residual particles trapped by said trapping means exceeding a preselected quantity, for indicating failure of said cleaning means.

2. An apparatus as recited in claim 1, wherein said cleaning means comprises a brush.

3. An apparatus as recited in claim 1, wherein said cleaning means comprises a blade.

4. An apparatus as recited in claim 1, further comprising a holder having said cleaning means mounted therein and in contact with the surface.

5. An apparatus as recited in claim 1, further comprising a holder having said cleaning means and said trapping means mounted therein.

6. An apparatus as recited in claim 5, wherein said holder comprises a substantially U-shaped member having said cleaning means mounted on one leg of said U-shaped member in contact with the surface and said trapping means mounted on the other leg of said U-shaped member in contact with the surface.

7. An apparatus as recited in claim 1, wherein said trapping means comprises a blade.

8. An apparatus as recited in claim 1, wherein said trapping means comprises a brush.

9. An apparatus as recited in claim 1, wherein said failure indicating means comprises:

a light source adapted to emit light rays therefrom; and with a photodetector adapted to receive light rays from said light source with the trapped residual particles preventing said photodetector from receiving light rays from said light source upon reaching the preselected quantity.

10. An apparatus as recited in claim 9, wherein said photodetector is located on one side of said trapping means and said light source is located linearly across from said photodetector at the opposite side of said trapping means.

11. An apparatus as recited in claim 10, wherein said photodetector transmits a signal indicating failure of said cleaning means in response to said photodetector not receiving the light rays.

12. An apparatus as recited in claim 1, wherein said trapping means continues to clean the surface as the residual particles build up.

* * * * *